US006175697B1

(12) United States Patent
Kopp et al.

(10) Patent No.: US 6,175,697 B1
(45) Date of Patent: Jan. 16, 2001

(54) METHOD AND APPARATUS FOR IMAGE DEVELOPMENT IN AN ELECTROGRAPHIC PRINTER OR COPIER

(75) Inventors: Walter Kopp, Taufkirchen; Martin Schleusener, Zorneding; Reinhard Apel, Vaterstetten, all of (DE)

(73) Assignee: Oce Printing Systems GmbH, Poing (DE)

( * ) Notice: Under 35 U.S.C. 154(b), the term of this patent shall be extended for 0 days.

(21) Appl. No.: 09/319,327

(22) PCT Filed: Dec. 18, 1997

(86) PCT No.: PCT/DE97/02977

§ 371 Date: Aug. 9, 1999

§ 102(e) Date: Aug. 9, 1999

(87) PCT Pub. No.: WO98/27470

PCT Pub. Date: Jun. 25, 1998

(30) Foreign Application Priority Data

Dec. 18, 1996 (DE) ..... 196 52 851

(51) Int. Cl.[7] ..... G03G 15/08
(52) U.S. Cl. ..... 399/53; 399/272
(58) Field of Search ..... 399/53, 58, 61, 399/55, 252, 253, 271, 272; 222/DIG. 1

(56) References Cited

U.S. PATENT DOCUMENTS 4,777,106 10/1988 Fotland et al. .
5,212,522 5/1993 Knapp .
5,235,385 * 8/1993 Rushing ..... 399/55

FOREIGN PATENT DOCUMENTS 29 30 785 2/1980 (DE) .
0 520 144 12/1992 (EP) .
0 494 454 4/1996 (EP) .
95/10801 4/1995 (WO) .

OTHER PUBLICATIONS

Japanese Abstract, 04238366, Aug. 26, 1992.

* cited by examiner

*Primary Examiner*—Quana Grainger
(74) *Attorney, Agent, or Firm*—Hill & Simpson

(57) ABSTRACT

A printer or copier has a developer station for a toner image wherein a photoconductive drum is provided with a latent charge image that is developed by applying a toner/air mixture to a developer drum that in turn applies the toner to the photoconductive drum. The toner is charged by a charging device as it is applied to the developer drum. A sensor senses the toner on the developer drum and a control varies the quantity of toner applied. The sensor is an optical sensor or a capacitive sensor, and the charge applied to the toner by the charging device is varied depending on the sensor output. A voltage applied to the developer drum may also be varied.

6 Claims, 4 Drawing Sheets

METHOD AND APPARATUS FOR IMAGE DEVELOPMENT IN AN ELECTROGRAPHIC PRINTER OR COPIER

BACKGROUND OF THE INVENTION

1. Field of the Invention

The present invention is directed to a method for the operation of an electrographic printer or copier, whereby a layer containing toner particles, referred to in brief as a toner layer, is deposited on a toner acceptance surface under the influence of a force field.

2. Description of Related Art

Such a method is implemented in the developer unit that is set forth in U.S. Pat. No. 4,777,106. Given this developer unit, the toner particles are electrically charged in a toner reservoir wherein a toner-air mixture is located and the toner particles are subsequently deposited on the toner acceptance surface that is grounded or provided with a potential, being deposited thereon as a toner layer under the influence of an electrical force field. Due to the rotation of a developer drum whose generated surface forms the toner acceptance surface, the deposited toner particles are conducted past a development gap between the developer drum and a toner image carrier. The toner image carrier carries a latent charge image onto which toner particles are selectively applied at the development gap, whereby a toner image arises. The toner image is then applied onto an ultimate image carrier, for example onto paper, from the toner image carrier with or without employment of an intermediate image carrier.

A developer unit having more than one toner acceptance surface is explained in European Patent EP 0 494 454 B 1. The second toner acceptance surface is the generated surface of a transfer drum on which the toner particles are applied directly from the reservoir. The toner particles are then deposited onto the surface of the developer drum at a transfer gap between the transfer drum and the developer drum.

What is disadvantageous about the known method is that a monitoring of the developing process and, in particle, of the amount of toner output by the developer unit is not possible. When the toner amount per surface on the toner acceptance surface or the charge of the toner particles during developing as well lies below or above a predetermined rated value or, respectively, rated range, then the error is not recognized until the finished print image. A reaction thus ensues relatively late. The disturbances in the print image are particularly noticeable given picture elements in the print image that are printed large-area.

In the known method, it is also not possible to exactly set the toner mass per surface section on the toner acceptance surface or the toner charge per surface section, to keep it constant during printing mode and to potentially adapt it to specific print jobs.

U.S. Pat. No. 5,212,522 discloses a method and an apparatus for controlling the mass-related toner charge q/m. The width of a gap between developer drum and a doctor for defining the thickness of the toner layer on the developer drum is employed as a manipulated variable. The gap width is modified with an additional adjustment mechanism. The rotational speed of the toner image carrier and the rotational speed of the developer drum are employed as an auxiliary manipulated variable.

Given a toner concentration monitoring mechanism according to German Patent Document DE 29 30 782 C2, a photo sensor is employed for acquiring the actual toner mass per unit of area on the developer drum. Dependent on the output signal of the photo sensor, the concentration of the toner in a two-component developer is slowly increased.

A developer unit is explained in PCT Patent Application WO, A, 95 10801. The developer unit contains a toner reception surface and an electrode. The toner mass per surface section is acquired with the assistance of a sensor unit. The strength of the charge field between the electrode and the toner reception surface (developer drum) is then set dependent on the output signal of the sensor unit in order to set the toner mass to a rated value.

European Patent Application EP A 0 520 144 explains a developer unit in which the mass relationship between toner and carrier particles is acquired with the assistance of a sensor. Dependent on the acquired mass relationship, printing process parameters such as the charge potential of the photoconductor, the bias potential of the developer unit, the illumination or the toner density are then controlled such an a control procedure that the influence of a modified mass relationship on the quality of the print image is compensated.

The Abstract of Japanese Patent Application JP, A, 0 4 238366 explains a method for the control of the toner concentration in a two-component toner. An optical sensor acquires the toner concentration. A motor for the delivery of toner is then controlled such in a control circuit dependent on the output signal of the sensor that a predetermined toner concentration is established. The optical density of a test mark that is located outside the image region is acquired in a second control circuit with the assistance of a sensor. Parameters of the printing process are then controlled such dependent on the output signal that a predetermined optical density derives.

Both dry toner as well as liquid toner are employed as toner. Given liquid toners, for example, mechanical devices with electrical auxiliary potential are employed for applying the toner. The toners that are employed can still be divided into a single-component and multi-component toner.

What are understood by the term electrographic printer are, in particular, electrophotographic printers, ionographic printers and magnetographic printers. It is also known to employ bands on which the toner layer is deposited instead of the developer drums.

SUMMARY OF THE INVENTION

An object of the invention is to provide a simple method for operating an electrographic printer or copier that enables developing with high quality.

This object is achieved by a method having the method steps of depositing a layer containing toner particles on a toner acceptance surface under the influence of a force field; acquiring the actual toner mass per surface section at at least one location of the layer; whereby the force field is modified in a first control circuit dependent on the deviation of the actual toner mass from a predetermined rated toner mass; and whereby the actual toner charge per surface section is acquired at at least one location of the layer, in that the charge of the toner particles of the layer is modified in a control circuit dependent on the deviation of the actual toner charge from a predetermined rated toner charge.

In a preferred embodiment, the rated toner charge lies above the value of the toner charge of the layer immediately after the application of the toner particles. The voltage in a development gap in which the toner particles are transferred from the toner acceptance surface onto a toner image carrier is taken into consideration in the prescription of the rated toner mass and/or of the rated toner charge.

The invention also provides a developer unit for an electrographic printer or copier, comprising a toner acceptance surface for the acceptance of a layer containing toner particles; a field generating means for generating a force field with which the toner particles are deposited on the toner acceptance surface; at least one sensor unit for acquiring the actual toner mass per surface section of the layer; a first control means that modifies the strength of the force field dependent on the deviation of the actual toner mass from a predetermined rated toner mass; and at least one sensor unit for acquiring the actual toner charge per surface section of the layer, characterized by at least one charging device arranged close to the toner acceptance surface for charging the toner particles on the toner acceptance surface; and by a second control means that modifies the charge behavior of the charging device dependent on the deviation of the actual toner charge from a predetermined rated toner charge. The developer unit is further characterized in that the charging device is a corotron or a scorotron that is preferably operated with a DC voltage superimposed by an alternating voltage. The toner acceptance surface is electrically conductive and has a bias potential that is taken into consideration in the prescription of the rated toner mass and/or of the rated toner charge. The developer unit is preferably provided in an apparatus for printing or copying.

The invention is based on the perception that characteristic quantities that critically define the quality of the developing process and, thus, critically define the quality of the print image as well must already be acquired during developing and not after the developing process has been terminated, in order to be able to react quickly given deviations of these characteristic quantities from rated values.

In the invention, the average actual toner mass per surface section is therefore acquired at at least one location of the layer. What the phrase per surface section thereby means is that a relatively uniform layer is assumed and the toner mass that is acquired is referred to a defined surface section of the toner layer of, for example, 1 $cm^2$. The total area of the toner layer is employed as a reference quantity. The average toner mass per surface section is also a criterion for the thickness of the layer. In the invention, the force field between a corona means and a developer drum for depositing the toner particles is modified in a control circuit dependent on the deviation of the actual toner mass per surface section from a predetermined, average rated toner mass per surface section. When the actual toner mass is higher than the rated toner mass, then the force field is modified such that fewer toner particles are deposited on the toner acceptance surface. When the actual toner mass is smaller than the rated toner mass, then the force field is modified such that more toner particles are deposited on the toner acceptance surface. When actual toner mass per surface section and rated toner mass per surface section coincide, then the force field is not modified. As a result of these measures, the actual toner mass can be exactly set to the value of the rated toner mass and can be kept constant during the printing operations. As required, the rated toner mass per surface section can also be modified during the printing operations.

Further, the average actual toner charge per surface section is acquired in the invention at at least one location of the toner layer. The charge of the toner particles of the layer is then modified in the control circuit dependent on the deviation between the actual toner charge per surface section and a predetermined rated toner charge per surface section. As a result of these measures, the toner charge per surface section is acquired as an important characteristic quantity of the developing process and is set to the value of the predetermined actual toner charge. During the printing operation, the actual toner charge is kept constant at the value which is predetermined by the rated toner charge. The result is an improvement of the print images arising during developing.

In the invention, the methods for controlling the toner mass per surface section and the toner charge per surface section are combined. For example, the control methods are combined in the fashion of a cascade control or of a relationship control. A control is also applied wherein the toner mass per surface section and the toner charge per surface section are placed in relationship, so that what is referred to as the mass-related toner charge is calculated as a controlled quantity. According to a predetermined control strategy, the toner mass per surface section and/or the toner charge per surface section is modified given a deviation of the mass-related toner charge from a predetermined value. The mass-related toner charge is one of the most critical characteristic quantities of the developing process. When the mass-related toner charge is kept constant during the entire development process, then the same quantity of toner particles, whose charge lies in a predetermined range, is always available for developing. During the entire developing process, the toner particles thus deposit uniformly at the locations of the toner image carrier to be developed. The result is a high-quality print image.

When the predetermined rated toner charge per surface section is selected such that it is higher in amount than the toner charge per surface section immediately after the application of the toner particles onto the toner acceptance surface, then charge losses of the toner particle charges during transport on the toner acceptance surface can be compensated in that the toner charge is increased in addition to the control of the toner charge.

In another exemplary embodiment of the invention, the voltage in a developing gap is taken into consideration given the prescription of the rated toner mass per surface section and/or of the rated toner charge per surface section. When an operator varies the voltage in the developing gap, for example when setting the contrast of the print image, then rated toner mass and rated toner charge are also to be automatically adapted in order to generate a high-quality print image.

A further aspect of the invention is directed to a developer unit for an electrographic printer or copier that, in particular, is utilized for the implementation of the above-explained methods. The technical effects cited above are thus also valid for the developer unit of the invention and the exemplary embodiments thereof.

BRIEF DESCRIPTION THE DRAWINGS

Exemplary embodiments of the invention are explained below with reference to the drawings.

DETAILED DESCRIPTION OF THE PREFERRED EMBODIMENTS

Figure 1:
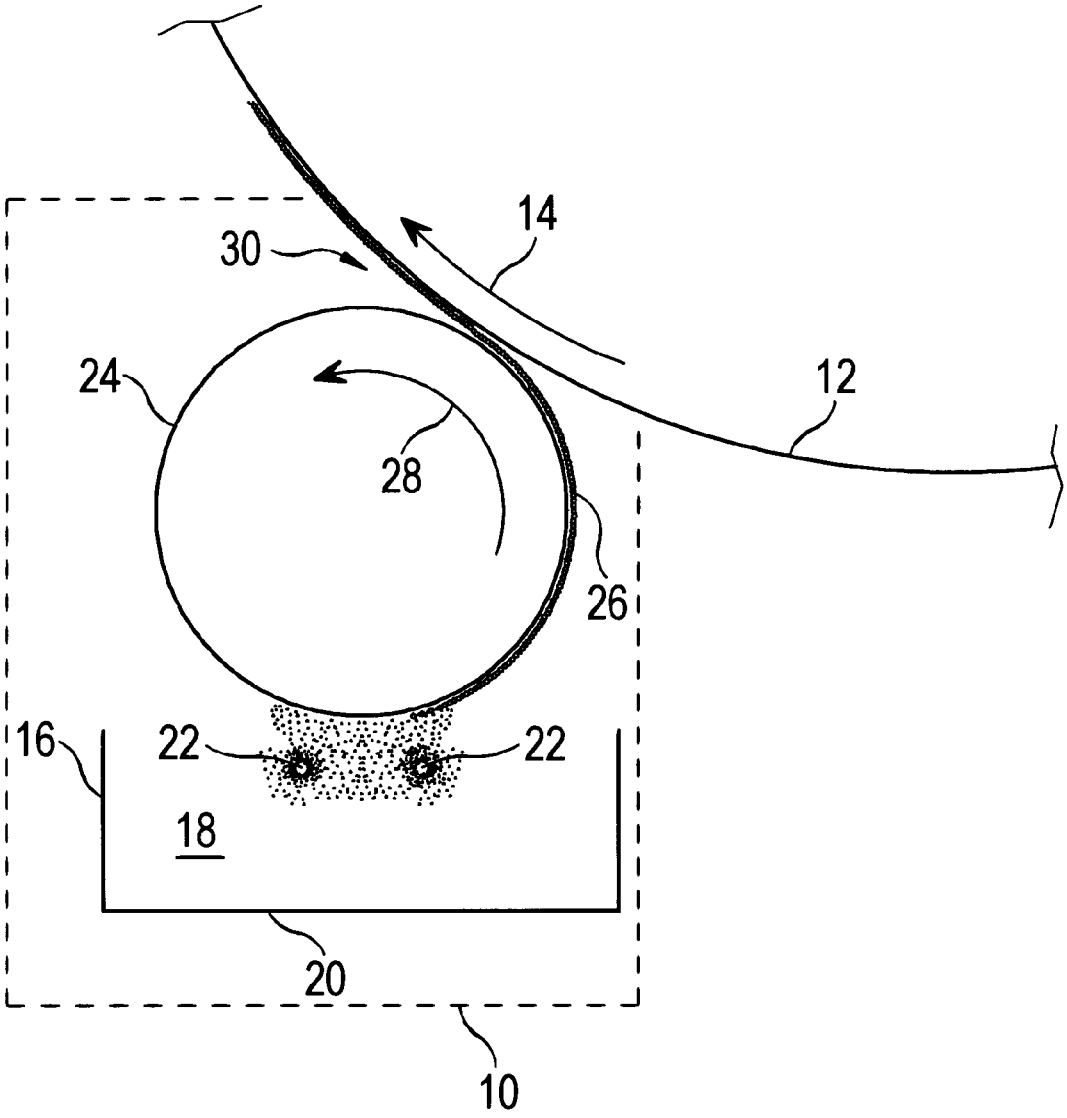
FIG. 1 is a schematic illustration of a developer unit with a developer drum in side view.

FIG. 1 schematically shows the structure of a developer unit 10 that is arranged close to a photoconductor drum 12, whereby the photoconductor drum 12 rotates in the direction of an arrow 14. A latent charge image that was applied by an illumination means (not shown) is located on the surface of the photoconductor drum 12 in the surface region facing toward the developer unit 10. The charges are distributed in the latent charge image according to the image information of the image to be printed. The drive means for the photoconductor drum 12 is not shown in FIG. 1 for the sake of simplicity in the illustration.

The developer unit 10 contains a container 16 in which a toner-air mixture 18 is located. Toner particles and air are mixed in roughly the ratio 1:10 in the mixture 18, as a result whereof the mixture 18 behaves like a liquid. The mixture 18 is thereby generated from solid toner particles having an average size of approximately 10 $\mu$m, whereby air flows large-area into the container 16 through an air-permeable bottom plate 20 of the container 16.

Two corona devices 22 are arranged in the toner-air mixture 18, a voltage of approximately −8 kV being respectively applied to these corona devices 22, so that toner particles of the mixture 18 are negatively charged in the environment of the corona devices 22. The corona devices 22 proceed parallel to one another transversely through the entire developer unit 10 over a length that approximately corresponds to the expanse of the photoconductor drum 12 transversely relative to the rotational sense 14 of the drum 12. A developer drum 24 whose axis proceeds parallel to the corona devices 22 is arranged above the corona devices 22. An electrically conductive surface layer of the developer drum 24 has a potential of approximately −0.6 kV, so that the negatively charged toner particles—due to the influence of the electrical field between the corona devices 22 and the developer drum 24—are deposited on the surface of the developer drum 24 over the entire length of the corona devices 22.

The surface of the developer drum 24 is located at a defined distance from the corona devices 22, so that a uniform toner layer 26 is deposited on the surface of the developer drum 24. The developer drum 24 is turned around its axis in the direction of an arrow 28 by a drive mechanism (not shown). During rotation, the toner layer 26 is transported on the circumference of the developer drum 24 until it reaches a development gap 30 that is formed by the surface of the photoconductor drum 12 and the surface of the developer drum 24, whereby both surfaces move synchronously relative to one another in the region of the development gap 30. The development gap 30 has a constant width over the entire length in the direction of the axis of the developer drum 24. The latent charge image of the photoconductor drum 12 is developed in the development gap in that counter particles of the toner layer 26 deposit in discharged areas of the surface of the photoconductor drum 12. Toner particles remaining on the developer drum 24 are removed from the surface layer of the developer drum 24 by a striper (not shown) before new toner particles are again applied in the region of the corona devices 22.

The toner image applied onto the photoconductor drum 12 is transferred onto paper in a transfer printing station (not shown) and is fixed in a fixing station.

Figure 2:
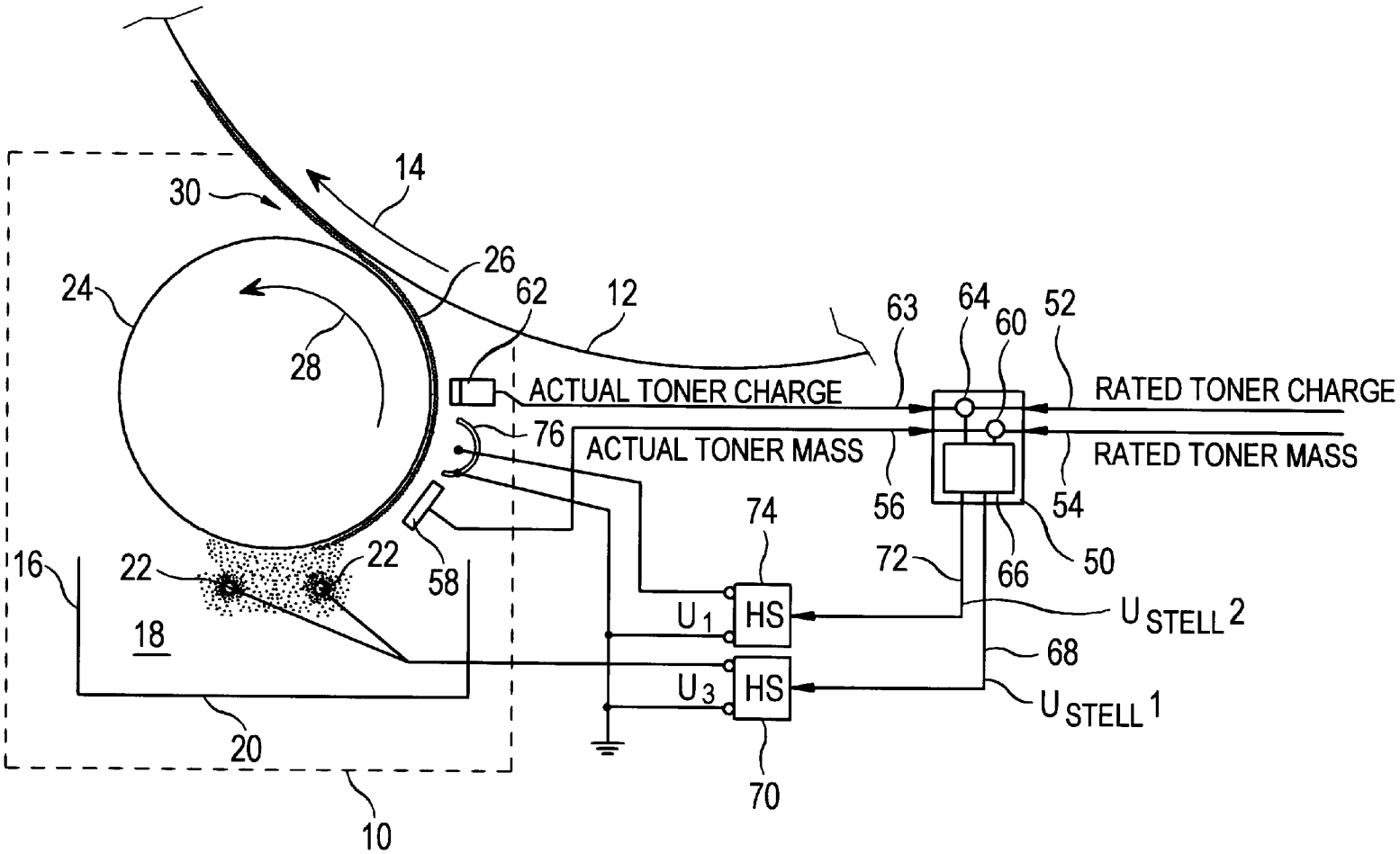
FIG. 2 is a functional block diagram of a developer unit with a control means for controlling the mass-related toner charge.

FIG. 2 shows the developer unit 10 with a control means 50. A rated toner charge that, for example, refers to a specific surface section of the toner layer 26 is prescribed for the control means 50 via a line 52. A rated toner mass for the surface section of the toner layer 26 is prescribed for the control means 50 as a target value via a line 54. Via a line 56, the control means 50 also receives signals from an optical sensor unit 58 that contains a light transmitter, a light receiver as well as an evaluation unit. The light emmitted by the light transmitter is re-emitted to the receiver by the toner layer 26.

With reference to the re-emission behavior of the toner layer 26 dependent on the actual toner mass per surface section, the actual toner mass per surface section in the toner layer 26 is identified in the sensor unit 58. Via the line 56, the momentary value of the actual toner mass proceeds to the control means 50 wherein the difference between the rated toner mass and the actual toner mass is formed in a subtractor 60, whereby a toner mass error signal pends at the output of the subtractor 60. Alternatively, the sensor unit 58 can also contain a capacitative sensor.

A potential sensor unit that has its output side connected to the control means 50 via a line 63 is also arranged close to the surface of the developer drum 24 covered with the toner layer 26. The potential sensor unit 62 contains an electrode at which a potential that is determined by the potential of the developer drum 24 and by the totality of the toner charge that is located on the surface of the developer drum 24 in the field region of the electrode is influenced. The sensor unit 62 also contains an evaluation unit that determines the actual toner charge from the influenced potential.

The difference between the rated toner charge and the actual toner charge is formed in a subtractor 64 that is contained in the control means 50. A toner charge error signal pends at the output of the subtractor 64.

The two error signals of the subtractors 60 and 64 are supplied to a controller 66 that, for example, contains two PI regulators, whereof one generates a setting voltage USTELL1 that is dependent on the toner mass error signal on an output line 68 of the control means 50, the setting voltage USTELL1 being applied to a controlled led power pack part 70. The control power pack part 70 generates a voltage U3 at its output that determines the potential at the corona devices 22. The voltage U3 is set dependent on the setting voltage USTELL1.

The voltage USTELL1 is prescribed such by the first PI regulator that the error signal of the subtractor 60 is reduced in amount and ultimately has the numerical value of "0". A first control circuit I thus contains the optical sensor unit 58, the control means 50, the power pack part 70 and the corona devices 22. The toner mass per surface section of the layer 26 is regulated with the assistance of the control circuit I in that, given too low a toner mass per surface section, the potential of the corona devices 22 is increased, so that more toner particles deposit on the surface of the developer drum 24. When the actual toner mass lies above the value that is prescribed by the rated toner mass, then the potential of the corona devices 22 is lowered. The result is that fewer toner particles deposit on the surface of the developer drum 24. Ultimately, one succeeds in keeping the actual toner mass per surface section constant according to the predetermined rated toner mass per surface section with the assistance of the control circuit.

Dependent on the toner charge error signal of the subtractor 64 on a line 72, the second PI regulator contained in the controller 66 generates a setting voltage USTELL2 that is applied to a control power pack part 74. Dependent on the value of the setting voltage USTELL2, a voltage U1 that influences the charge behavior of a corotron 76 is generated at the output of the power pack part 74. The second PI regulator prescribes the setting voltage USTELL2 such that the error signal of the subtractor 64 is reduced in amount and ultimately has the numerical value of "0" until noise quantities lead to a new control procedure. A second control circuit II thus contains the potential sensor unit 62, the control means 50, the power pack part 74 and the corotron 76. When the actual toner charge per surface section on the toner layer 26 decreases, then the voltage U1 is increased, so that the charge behavior of the corotron 76 is also boosted. When the actual toner charge per surface section of the layer 26 exceeds the predetermined rated value, then the voltage U1 is diminished, so that fewer charges are applied onto the toner layer 26 by the corotron 76. With the control circuit II, one succeeds in keeping the actual toner charge per surface section constant according to the predetermined rated toner charge per surface section during the developing process.

In a further exemplary embodiment, the control means 50 is given a mass-referred rated toner charge instead of the rated toner charge per surface section and instead of the rated toner mass per surface section. The mass-referred toner charge qT is calculated according to the following equation.

$$qT=QT/MT$$

Whereby QT is the toner charge per surface section and MT is the toner mass per surface section. The prescribed, mass-referred rated toner charge is compared to a mass-referred the actual toner charge that is determined from actual toner charge and the actual toner mass with the above-recited equation. The mass-referred toner charge QT on the layer 26 is ultimately kept constant during the developing process on the basis of a predetermined control strategy of the control means 50.

Figure 3:
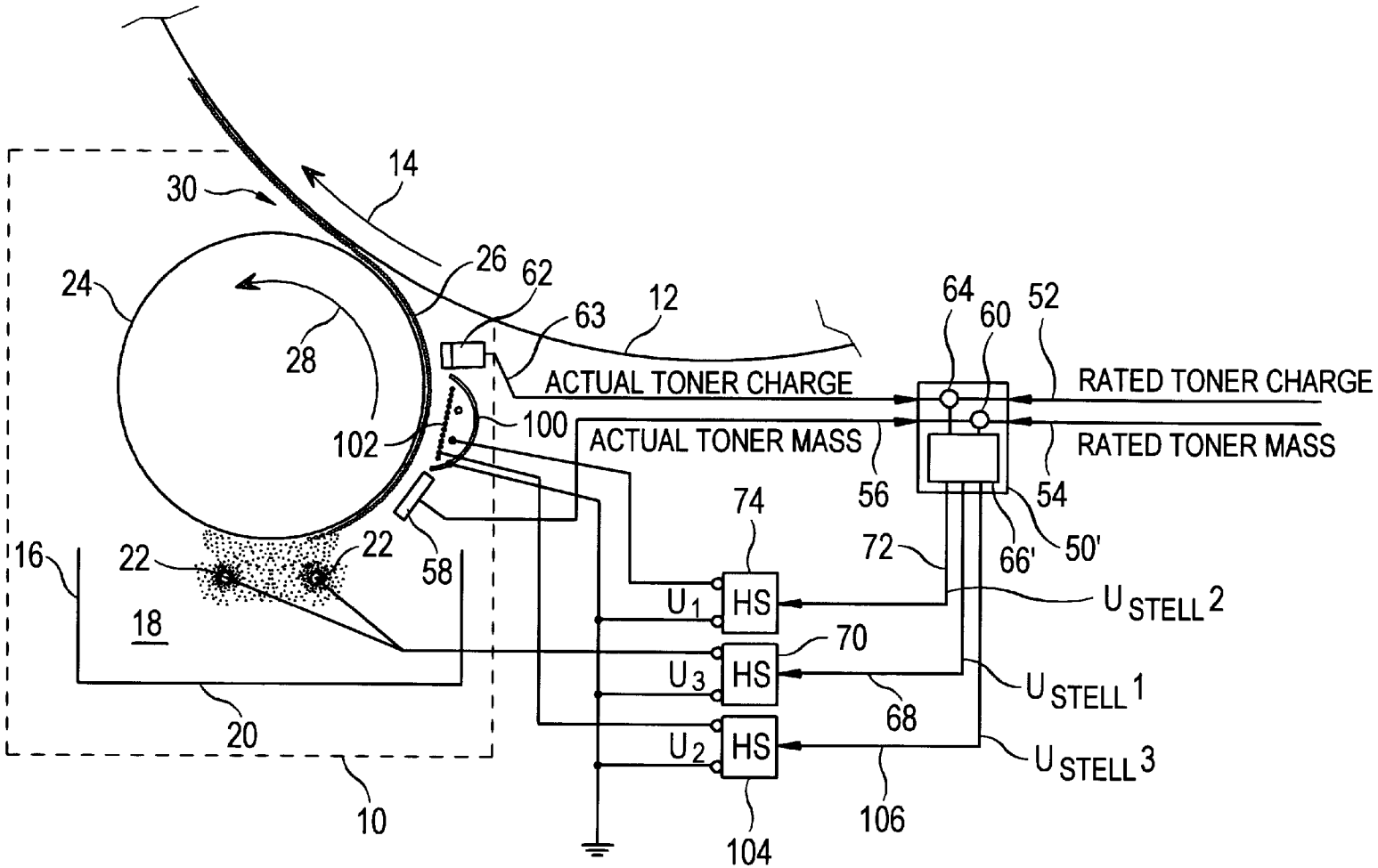
FIG. 3 is a functional block diagram of a developer unit with a control means for controlling the mass-related toner charge with the assistance of a scorotron [sic]

FIG. 3 shows the developer unit 10, whereby a control means 50' controls the mass-referred toner charge of the toner on the layer 26 with the assistance of a scorotron 100. The control means 50' is constructed like the control means 50 (see FIG. 2), but contains a regulator 66' instead of the regulator 66. The scorotron 100 is employed instead of the corotron 76 (see FIG. 2) and additionally contains a control grid 102 at which a voltage U2 is adjacent. The voltage U2 is generated by a controlled power pack part 104 dependent on an input voltage USTELL3. The voltage U1 is applied to corona wires of the scorotron 100, as it is at the corotron 76 (see FIG. 2). The voltage U1 is preferably a DC voltage superimposed by an alternating voltage.

For controlling the toner charge per surface section, the control means 50' outputs a setting voltage USTELL3 that is supplied to the input of the power pack part 104 with a line 106. The power pack part 104 and the control grid 102 are component parts of the aforementioned control circuit II. The setting voltage USTELL3 is thus selected such that the actual toner charge per surface section adjusts to the value prescribed by the rated toner charge per surface section.

Figure 4:
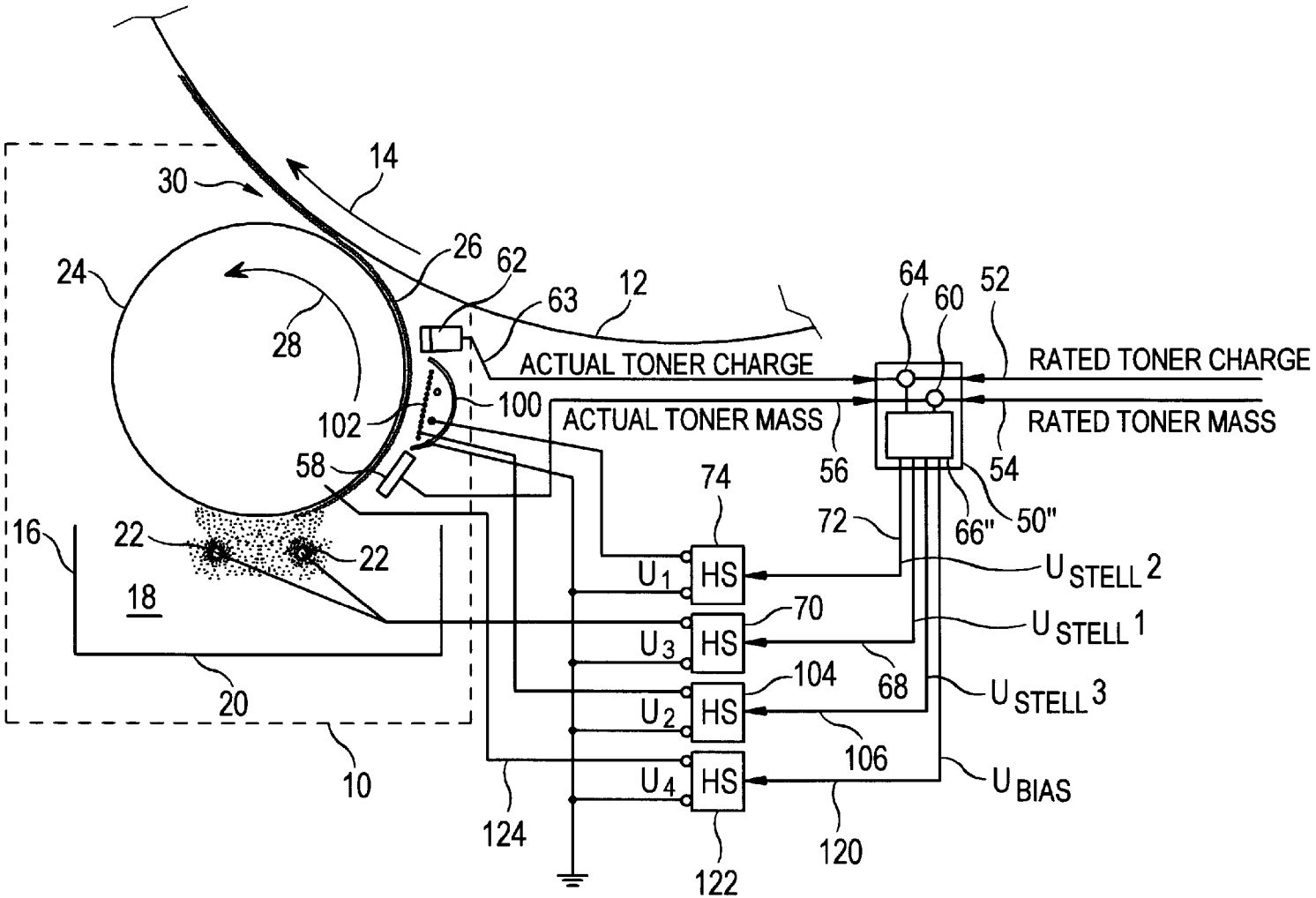
FIG. 4 is a functional block diagram of a developer unit with a control means for controlling the mass-related toner charge taking the electrical voltage in a development gap into consideration.

FIG. 4 shows the developer unit 10 and a control device 50" that takes the potential of the surface of the developer drum 24 into consideration in the regulation of the mass-referred toner charge. The control means 50" is constructed essentially like the control means 50' (see FIG. 3). Instead of the regulator 66', however, it contains a regulator 66" that also takes the momentary potential of the developer drum 24 into consideration when regulating. This potential is derived, for example, from the contrast value that an operator of the printer input.

The control means 50" is connected via a line 120 to a controlled power pack part 122, whereby a bias signal is communicated on the line 120. Dependent on the value of the bias signal, a voltage U4 is generated in the power pack part 122, this voltage being applied to the conductive surface of the developer drum 24 via a line 124. The value of the potential on the developer drum 24 that is respectively selected influences both the control circuit I as well as the control circuit II since it determines the value of the rated toner charge and of the rated toner mass.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for operation of an electrographic printer or copier, comprising the steps of:

depositing a layer containing toner particles on a toner acceptance surface under influence of a force field;

acquiring actual toner mass per surface section at at least one location of the layer;

modifying the force field in a first control circuit dependent on deviation of the actual toner mass from a predetermined rated toner mass;

acquiring actual toner charge per surface section at at least one location of the layer, and modifying charge of the toner particles of the layer in a control circuit dependent on deviation of the actual toner charge from a predetermined rated toner charge, wherein the predetermined rated toner charge lies above the value of the toner charge of the layer immediately after application of the toner particles.

2. A developer unit for an electrographic printer or copier, comprising;

a toner acceptance surface for acceptance of a layer containing toner particles;

a field generator for generating a force field with which the toner particles are deposited on the toner acceptance surface;

at least one sensor unit for acquiring actual toner mass per surface section of the layer;

a first control that modifies a strength of the force field dependent on deviation of the actual toner mass from a predetermined rated toner mass;

at least one sensor unit for acquiring the actual toner charge per surface section of the layer, at least one charging device arranged close to the toner acceptance surface for charging the toner particles on the toner acceptance surface; and a second control that modifies charge behavior of the at least one charging device dependent on deviation of the actual toner charge from a predetermined rated toner charge.

3. A developer unit according to claim 2 wherein the at least one charging device is one of a corotron and a scorotron.

4. A developer unit according to claim 2, wherein the toner acceptance surface is electrically conductive and has a bias potential that is taken into consideration in the prescription of at least one of the rated toner mass and of the rated toner charge.

5. An apparatus for printing or copying, comprising:

a developer unit including:

a toner acceptance surface for acceptance of a layer containing toner particles:

a field generator for generating a force field with which the toner particles are deposited on the toner acceptance surface;

at least one sensor unit for acquiring actual toner mass per surface section of the layer;

a first control that modifies a strength of the force field dependent on deviation of the actual toner mass from a predetermined rated toner mass;

at least one sensor unit for acquiring the actual toner charge per surface section of the layer, at least one charging device arranged close to the toner acceptance surface for charging the toner particles on the toner acceptance surface; and a second control that modifies charge behavior of the at least one charging device dependent on deviation of the actual toner charge from a predetermined rated toner charge.

6. A developer unit according to claim 3, wherein the one of the corotron and the scorotron is operated with a DC voltage superimposed by an alternating voltage.

* * * * *